US009453702B2

(12) United States Patent
Bruhns

(10) Patent No.: US 9,453,702 B2
(45) Date of Patent: Sep. 27, 2016

(54) FIREARM HANDGRIP ASSEMBLY WITH LASER GUNSIGHT SYSTEM

(71) Applicant: Hogue, Inc., Henderson, NV (US)

(72) Inventor: James David Bruhns, Templeton, CA (US)

(73) Assignee: HOGUE, INC., Henderson, NV (US)

( * ) Notice: Subject to any disclaimer, the term of this patent is extended or adjusted under 35 U.S.C. 154(b) by 0 days.

(21) Appl. No.: 14/964,503

(22) Filed: Dec. 9, 2015

(65) Prior Publication Data

US 2016/0202018 A1 Jul. 14, 2016

Related U.S. Application Data

(63) Continuation of application No. 14/592,976, filed on Jan. 9, 2015, now abandoned.

(51) Int. Cl.

| | |
|---|---|
| ***F41G 1/35*** | (2006.01) |
| ***F41C 23/10*** | (2006.01) |
| ***F41C 23/16*** | (2006.01) |

(52) U.S. Cl.

CPC ..... *F41C 23/16* (2013.01); *F41G 1/35* (2013.01)

(58) Field of Classification Search

CPC ..... F41C 23/10; F41C 23/16; F41G 11/001; F41G 1/3321; F41G 1/32; F41G 1/34; F41G 1/35; F41G 1/00; F41G 3/2616; F41G 3/2655; F41A 27/00; F41A 35/00

USPC ..... 42/114, 117, 71.02

See application file for complete search history.

(56) References Cited

U.S. PATENT DOCUMENTS

| | | | |
|---|---|---|---|
| 958,332 | A | 5/1910 | Snyder |
| 1,263,667 | A | 4/1918 | Henderson et al. |
| 2,450,584 | A | 10/1948 | Dodge |
| 5,056,254 | A | 10/1991 | Bechtel |

(Continued)

FOREIGN PATENT DOCUMENTS

| | | |
|---|---|---|
| EP | 00100985.1 | 3/2000 |

OTHER PUBLICATIONS

Crimson Trace, LG-401 for 1911 Full-Size Government/Commander Installation Handbook Lasergrips(R), Published Oct. 2010.

(Continued)

*Primary Examiner* — Bret Hayes
*Assistant Examiner* — Derrick Morgan
(74) *Attorney, Agent, or Firm* — Bennet K. Langlotz; Langlotz Patent & Trademark Works, Inc.

(57) ABSTRACT

A firearm handgrip assembly with laser gunsight system has a frame, the frame having an attachment facility adapted for secure connection to a firearm, the frame having a connection facility associated with an optical passage, an elongated beam projection element having a first end connected to the connection facility, and an opposed second end, the beam projection element operable to emit a beam from the first end, and the frame including an aiming facility operable to adjust the position of the second end of the beam projection element while the first end remains connected to the connection facility. The first end of the beam projection element may be pivotally connected to the connection facility. The beam projection element and the connection facility may be connected by a ball and socket joint. The first end of the beam projection element may include a spherical surface.

17 Claims, 15 Drawing Sheets

(56) References Cited

U.S. PATENT DOCUMENTS 5,179,235 A * 1/1993 Toole ..... F41G 1/35 362/110
5,194,007 A 3/1993 Marshall et al.
5,282,594 A 2/1994 Huang
5,388,364 A * 2/1995 Paldino ..... F41G 1/35 362/114
5,430,967 A 7/1995 Woodman et al.
5,435,091 A 7/1995 Toole et al.
5,485,695 A 1/1996 Glock
5,557,872 A * 9/1996 Langner ..... F41C 23/22 362/114
5,560,703 A 10/1996 Capps, III
5,581,898 A 12/1996 Thummel
6,590,486 B2 1/1997 Moore
5,621,999 A 4/1997 Moore
5,654,594 A 8/1997 Bjornsen et al.
5,706,600 A * 1/1998 Toole ..... F41G 1/35 362/114
5,758,448 A 6/1998 Thummel
5,784,823 A 7/1998 Chen
6,054,939 A * 4/2000 Wei ..... H01H 13/70 200/513
6,185,854 B1 2/2001 Solinsky et al.
6,230,431 B1 5/2001 Bear
6,276,088 B1 8/2001 Matthews et al.
6,378,237 B1 4/2002 Matthews et al.
6,393,752 B1 5/2002 Oliver et al.
6,438,888 B1 8/2002 Lin et al.
6,571,503 B2 6/2003 Thorpe
6,574,901 B1 6/2003 Solinsky et al.
6,578,311 B2 6/2003 Danielson et al.
6,591,536 B2 * 7/2003 Houde-Walter ..... F41G 1/35 42/11
D487,791 S 3/2004 Freed
6,854,205 B2 2/2005 Wikle et al.
7,117,627 B2 10/2006 Woodmansee, III et al.
7,199,315 B1 * 4/2007 Sharrah ..... F41A 17/06 200/511
D542,446 S 5/2007 DiCarlo et al.
7,260,910 B2 8/2007 Danielson
7,275,344 B2 10/2007 Woodmansee, III et al.
D567,894 S 4/2008 Sterling et al.
7,395,627 B2 7/2008 La France et al.
7,449,650 B2 * 11/2008 Richardson ..... G05G 1/02 200/331
7,523,583 B2 4/2009 Cheng
D603,478 S 11/2009 Hughes
7,805,876 B1 * 10/2010 Danielson ..... F41C 23/10 362/114
7,845,105 B1 * 12/2010 Cahill ..... F41C 23/16 200/86 R
8,256,154 B2 9/2012 Danielson et al.
8,365,456 B1 * 2/2013 Shepard, Jr. ..... F41C 23/10 362/110
8,662,694 B1 * 3/2014 Izumi ..... F41G 1/34 362/109
D738,987 S * 9/2015 Hughes ..... D22/109
9,243,865 B1 * 1/2016 Bruhns ..... F41C 23/16
2003/0196366 A1 10/2003 Beretta
2007/0235298 A1 * 10/2007 Kim ..... F41G 1/34 200/18
2007/0264616 A1 * 11/2007 Namgung ..... 434/16
2007/0277422 A1 * 12/2007 Ding ..... F41G 1/35 42/146
2009/0293855 A1 * 12/2009 Danielson ..... F41G 1/467 124/87
2010/0128470 A1 * 5/2010 Swan ..... A42B 3/044 362/191
2011/0048909 A1 * 3/2011 Clark ..... H01H 9/181 200/330
2012/0227251 A1 * 9/2012 Hyuga ..... H01H 13/88 29/622
2012/0325637 A1 * 12/2012 Kikuchi ..... H01H 13/063 200/520
2013/0062173 A1 * 3/2013 Kang ..... H01H 13/063 200/337
2013/0067789 A1 * 3/2013 Moore ..... F41G 1/35 42/90
2013/0185982 A1 * 7/2013 Hilbourne ..... F41G 1/35 42/117
2013/0299324 A1 * 11/2013 Kanbayashi ..... H01H 9/04 200/302.1
2015/0198417 A1 * 7/2015 Werner ..... D22/109

OTHER PUBLICATIONS

Armalaser Inc., http://www.armalaser.com/Kel_Tec_P32_P3AT-KEL_TEC_P32_P3AT.html, Accessed Sep. 12, 2008.

Ontargetsportsonline.com, The "Pocket Slipper Laser Aimer," http://www.ontargetsportsonline.com/images/ LaserSights/PS_Info-Opt.jpg, Accessed Sep. 12, 2008.

Laserlyte, Pocket Pistol Laser for Ruger LCP, http://www.laserlyte.com/download/graphics/PL-1.html, Accessed Aug. 3, 2009.

* cited by examiner

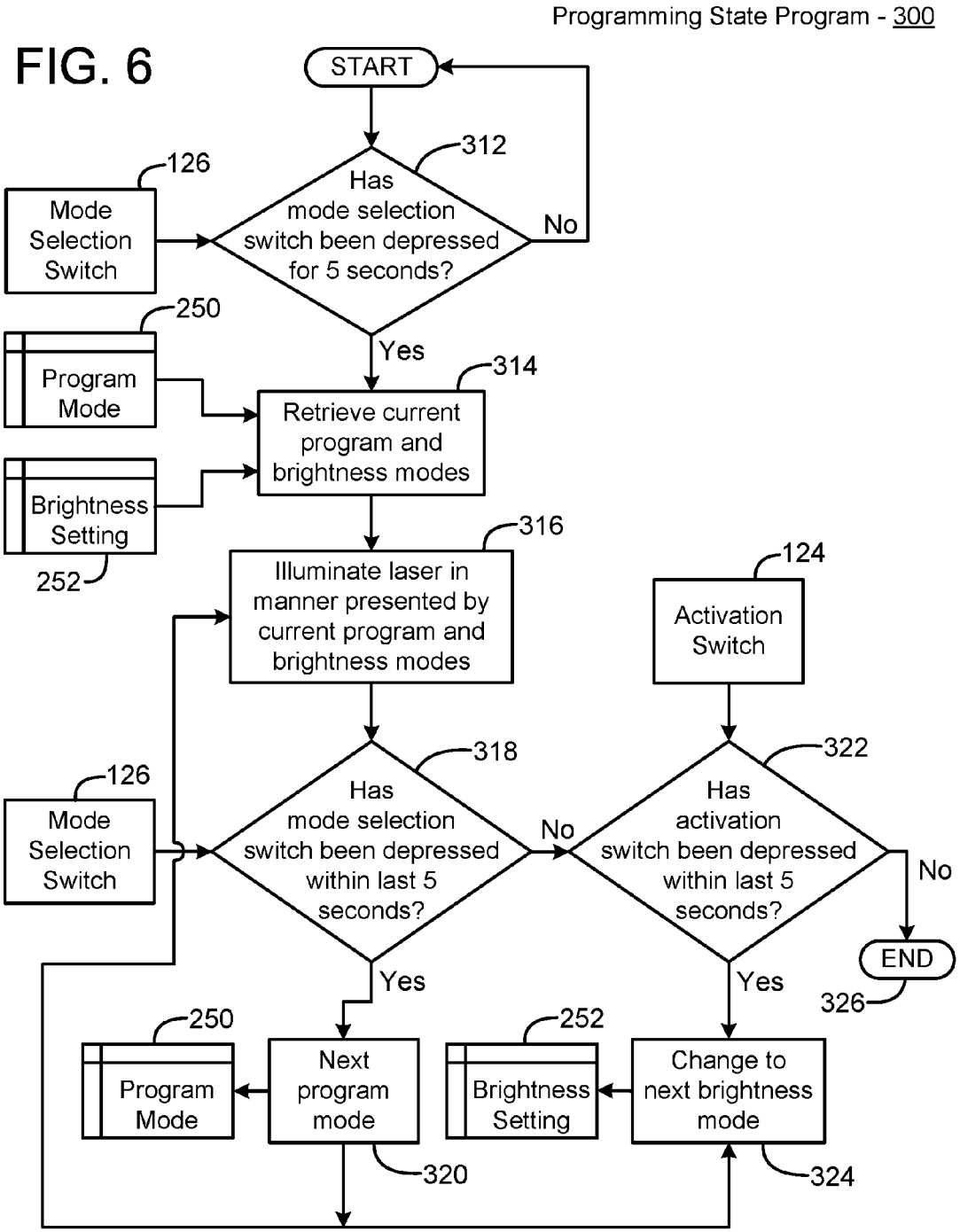
Programming State Program - 300
FIG. 6
START
312
Has mode selection switch been depressed for 5 seconds?
No
Yes
126
Mode Selection Switch
250
Program Mode
314
Retrieve current program and brightness modes
Brightness Setting
252
316
Illuminate laser in manner presented by current program and brightness modes
124
Activation Switch
318
Has mode selection switch been depressed within last 5 seconds?
No
322
Has activation switch been depressed within last 5 seconds?
No
END
326
Yes
Yes
126
Mode Selection Switch
250
Program Mode
Next program mode
320
252
Brightness Setting
Change to next brightness mode
324

FIREARM HANDGRIP ASSEMBLY WITH LASER GUNSIGHT SYSTEM

CROSS-REFERENCE TO RELATED APPLICATIONS

This is a Continuation of U.S. patent application Ser. No. 14/592,976 filed on Jan. 9, 2015, entitled "FIREARM HANDGRIP ASSEMBLY WITH LASER GUNSIGHT SYSTEM."

FIELD OF THE INVENTION

The present invention relates to firearm grip assemblies for handguns, and more particularly to a device that replaces the standard factory-supplied firearm handgrips without requiring significant modification of the firearm and enhances the functionality of the firearm by providing a laser gunsight operable by the user while the firearm is gripped by the handgrip in the firing position.

BACKGROUND OF THE INVENTION

Lasers are commonly used for firearm sighting when light conditions are poor, such as at night or in the darkened rooms of buildings. They are often used by police and military users of firearms, who need to be able to quickly and accurately aim the firearm at a poorly-illuminated target under low light conditions. They are increasingly popular for use with handguns, which are otherwise potentially difficult to aim and shoot accurately.

Laser sights have been developed that employ a battery-powered laser that has been sighted-in so that the laser illuminates the firearm's point of impact. The target reflects the laser beam back to the user, which informs the user exactly where the firearm is aimed and where the bullet will impact if the firearm is fired.

Various laser gunsight systems have been developed for use with firearms that are equipped with a handgrip. One example is the LG-401 LASERGRIPS® manufactured by Crimson Trace® of Wilsonville, Oreg. The standard factory-supplied grips are removed from the firearm and replaced by two panels that are screwed onto the firearm's frame. The two panels are connected by a front activation pad that wraps around the front strap of the firearm's handgrip. The handgrip is grasped by the user's hand when the firearm is being held in the firing position, and a laser attached to the top of the right grip is turned on while the front activation pad is depressed. The laser housing includes set screws to adjust the laser's elevation and windage when the laser is sighted-in by firing rounds at a target and noting any aiming error. The two batteries are capable of powering the laser for about four hours of illumination.

However, the LG-401 LASERGRIPS® has a significant disadvantage in that the sighting-in process of the laser has to be repeated every time the batteries are changed. One of the two batteries cannot be replaced unless the right grip holding the laser is removed from the firearm so the battery can be accessed and replaced. When the right grip is reattached, there is no guarantee the laser beam will still accurately reflect the firearm's point of impact. Battery replacement is recommended at least annually, and even more frequently for heavy users, which creates considerable inconvenience if a shooting range is not readily available. Furthermore, if the batteries begin to fail or experience a complete failure in the field, the user cannot replace them without taking the chance that the laser beam will no longer accurately indicate the firearm's point of impact.

The LG-401 LASERGRIPS® has an additional disadvantage in that its exterior mimics the standard hard factory-supplied firearm grips for handguns. It is often desirable to utilize firearm handgrip assemblies composed of rubber or other relatively soft elastomers instead. The use of a soft firearm handgrip assembly provides the user with a more secure grip. Such firearm handgrip assemblies often include ergonomic features such as finger ridges and palm swells to provide adequate security for holding the gun during recoil. The firearm handgrip assemblies may also provide a larger grip circumference than the standard factory-supply firearm handgrips to accommodate users with larger hands. Firearm grip assemblies may include rigid inserts for reinforcement of the elastomer material.

Therefore, a need exists for a new and improved firearm handgrip assembly that provides a laser gunsight system with batteries that can be changed without detaching the laser from the firearm and that provides ergonomic features. In this regard, the various embodiments of the present invention substantially fulfill at least some of these needs. In this respect, the firearm handgrip assembly according to the present invention substantially departs from the conventional concepts and designs of the prior art, and in doing so provides an apparatus primarily developed for the purpose of providing a laser gunsight system with batteries that can be changed without detaching the laser from the firearm and providing ergonomic features.

SUMMARY OF THE INVENTION

The present invention provides an improved firearm handgrip assembly with laser gunsight system, and overcomes the above-mentioned disadvantages and drawbacks of the prior art. As such, the general purpose of the present invention, which will be described subsequently in greater detail, is to provide an improved firearm grip sleeve with laser gunsight system that has all the advantages of the prior art mentioned above.

To attain this, the preferred embodiment of the present invention essentially comprises a frame, the frame having an attachment facility adapted for secure connection to a firearm, the frame having a connection facility associated with an optical passage, an elongated beam projection element having a first end connected to the connection facility, and an opposed second end, the beam projection element operable to emit a beam from the first end, and the frame including an aiming facility operable to adjust the position of the second end of the beam projection element while the first end remains connected to the connection facility. The first end of the beam projection element may be pivotally connected to the connection facility. The beam projection element and the connection facility may be connected by a ball and socket joint. The first end of the beam projection element may include a spherical surface. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

FIG. 6 is a flowchart of the programming state program for use with current embodiment of the firearm handgrip assembly with laser gunsight system of FIG. 1.

The same reference numerals refer to the same parts throughout the various figures.

DESCRIPTION OF THE CURRENT EMBODIMENT

Figure 1:
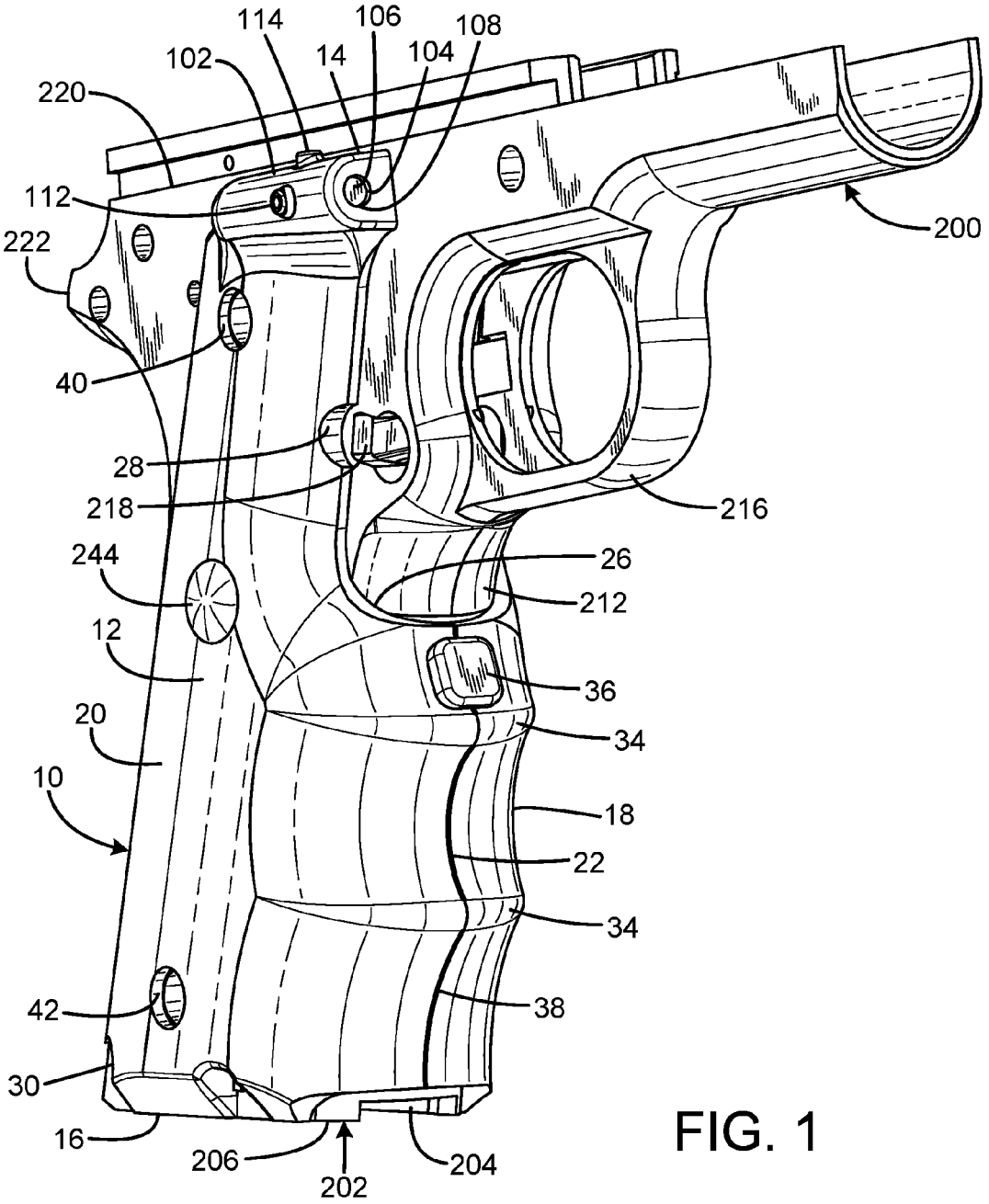
FIG. 1 is a front isometric view of the current embodiment of a firearm handgrip assembly with laser gunsight system constructed in accordance with the principles of the present invention installed on the pistol frame of a M1911-type pistol.
Figure 2:
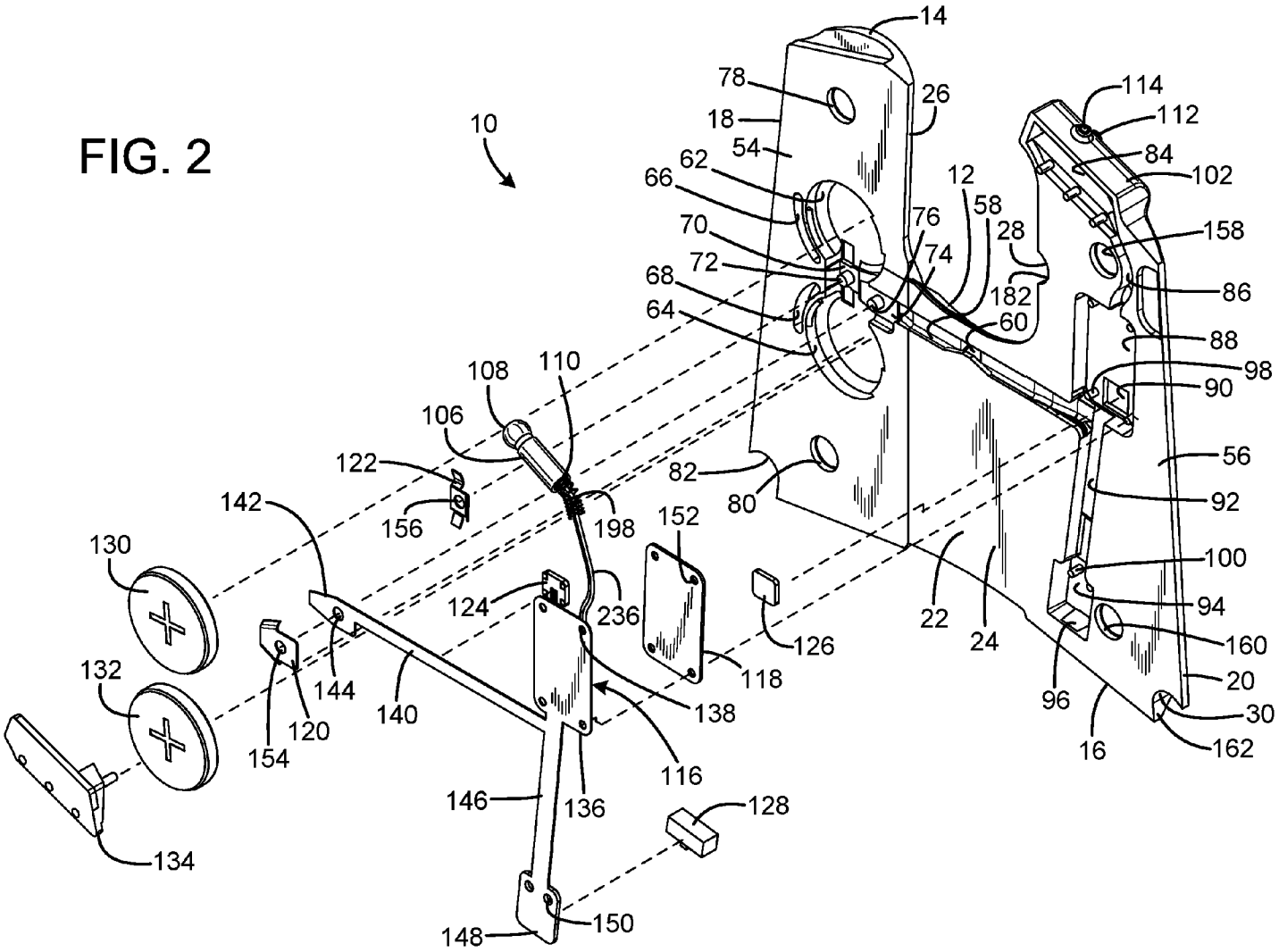
FIG. 2 is an exploded view of the current embodiment of the firearm handgrip assembly with laser gunsight system of FIG. 1.

An embodiment of the firearm handgrip assembly with laser gunsight system of the present invention is shown and generally designated by the reference numeral 10.

FIGS. 1-4 illustrate the improved firearm handgrip assembly with laser gunsight system 10 of the present invention for use with a pistol having removable grips. This type of pistol typically has a molded plastic grip with a curved exterior to be comfortably received in a user's hand. The pistol includes a removable back strap insert (not shown). Only the frame 200 of the pistol is illustrated for clarity. More particularly, the one-piece integrally molded plastic frame shown is for an M1911 pistol.

The frame 200 has a downwardly-extending handgrip 202 that angles slightly rearward and is a tubular body defining an elongated well 204 capable of closely receiving a removable magazine (not shown). The handgrip has a lower free end 206. The grip has flat or gently curved right and left side portions 208, 210, a straight semi-cylindrical front strap 212 facing forward, and a curved back strap recess 214 facing rearward. The handgrip generally has an oblong, oval or "racetrack" cross-section. At the upper end of the front strap, a trigger guard 216 projects forward and upward to protect the trigger (not shown) from accidental activation. A magazine release (not shown) protrudes transversely from the frame in front of the handgrip through a magazine release aperture 218. The back strap extends nearly to the upper edge 220 of the frame, curving rearward at its upper portion. A beavertail protrusion portion 222 of the frame protrudes rearward at the upper end of the back strap recess.

The pistol frame 200 includes two screw holes on each of the left and right side portions of the handgrip 202 (screw holes 224, 226 on the right side portion 208 are visible) that receive screws to attach standard factory-supplied grips (not shown) or replacement grips such as those provided by the firearm handgrip assembly with laser gunsight system 10. When the pistol frame is assembled for use, it also includes a back strap insert (not shown), which is a curved insert that is normally located on the rear of the grip immediately below the beavertail. The back strap insert is received by the back strap recess and has mating features that engage with the handgrip. Specifically, the pistol frame includes one screw hole 228, 230 on each of the left and right side portions adjacent to the lower free end 206 to secure the back strap insert. With the back strap insert and the grips installed, the handgrip has a curved and continuous surface to provide a secure comfortable grip, in the manner of any pistol. With the back strap and grips removed, the handgrip has discontinuities, steps, cavities, and other features that render it unsuitable for use.

Figure 3:
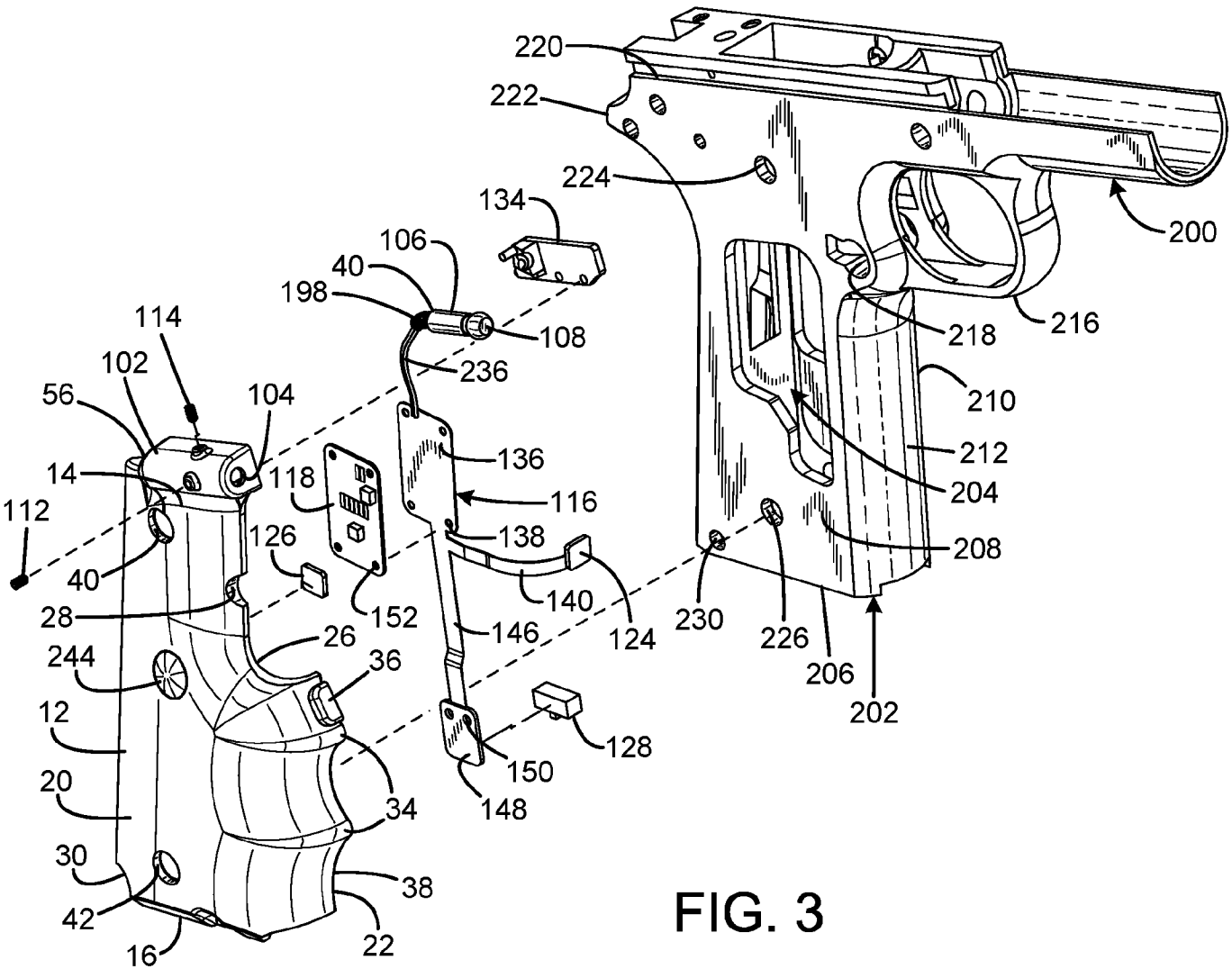
FIG. 3 is an exploded view of the right side of the current embodiment of the firearm handgrip assembly with laser gunsight system of FIG. 1.
Figure 4:
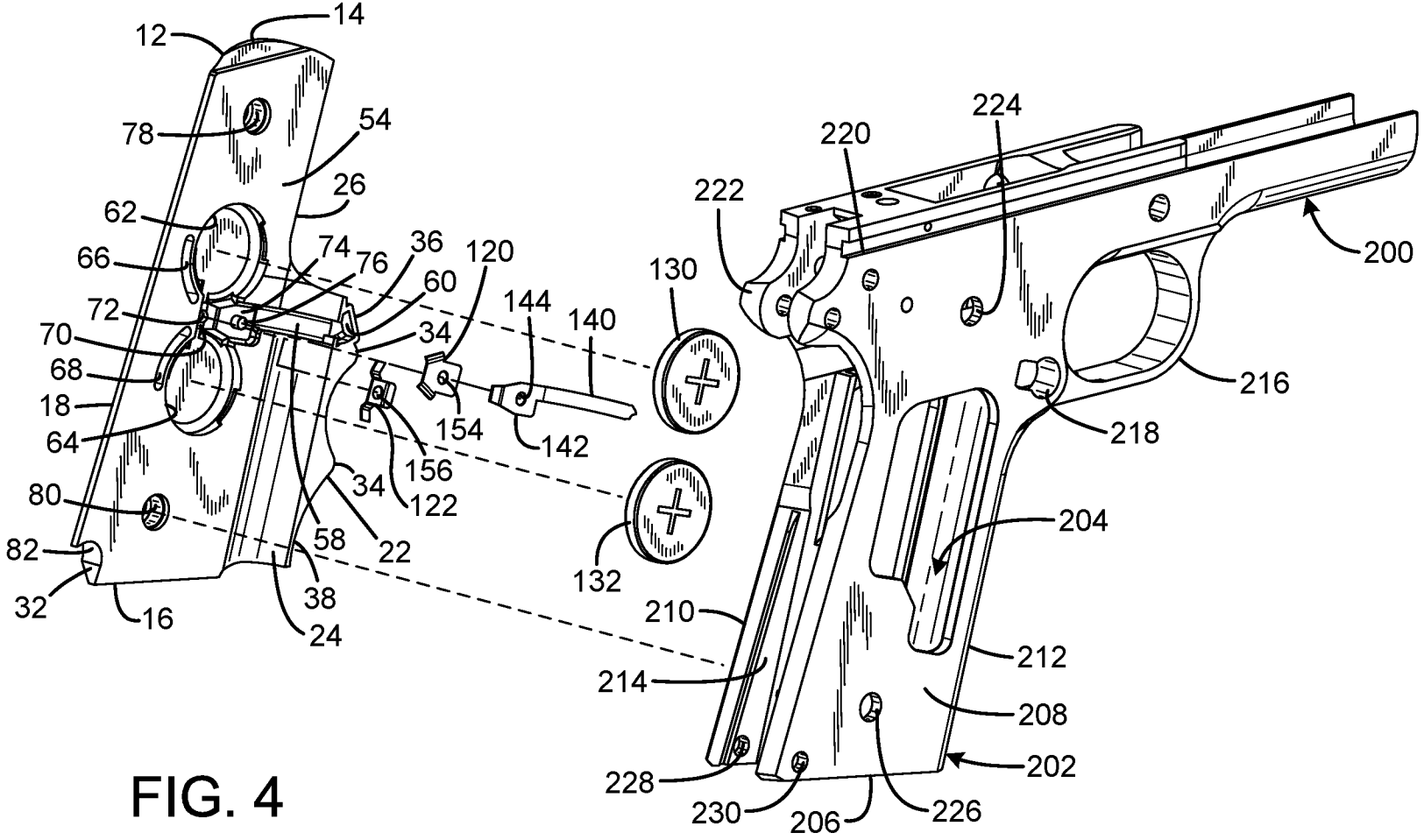
FIG. 4 is an exploded view of the left side of the current embodiment of the firearm handgrip assembly with laser gunsight system of FIG. 1.

The firearm handgrip assembly with laser gunsight system 10 of the present invention includes an exterior skin 12 with a top 14, a bottom 16, a left side 18, a right side 20, a front 22, and an interior surface 24. FIGS. 3 and 4 depict the firearm handgrip assembly with laser gunsight system 10 as if it were composed of discrete first and second grip body halves with a flexible connection portion for clarity, but the exterior skin 12 is continuous in the current embodiment. As a result, the flexible connection portion provides a continuous external surface of the firearm handgrip assembly with laser gunsight system 10 when the firearm handgrip assembly with laser gunsight system is connected to a frame 200. The top of the exterior skin defines a U-shaped trigger guard notch 26. The trigger guard notch provides clearance for the trigger guard 216. The right side of the trigger guard notch includes a magazine release notch 28. The magazine release notch 28 provides clearance for the magazine release aperture 218. The bottom of the exterior skin defines a notch 30, 32 on each side. The notches 30, 32 provide clearance for the back strap insert holes 228, 230. The roles of the notches 28, 30, 32 are best shown in FIG. 1.

A plurality of ridges 34 extends from the front 22 of the exterior skin 12. The ridges define a plurality of grooves between the ridges that receive the user's fingers when the pistol is held in a firing position. The front of the exterior skin also defines an activation switch cover 36 and a hinge 38. The activation switch cover is a flexible membrane in the current embodiment. The hinge joins the left side 18 of the exterior skin to the right side 20 of the exterior skin. The left and right sides of the exterior skin each define two screw holes (screw holes 40, 42 on the right side and screw holes 44, 46 on the left side). The screw holes on the exterior skin are axially registered with the screw holes 224, 226 on the pistol frame 200 so factory-supplied grip screws (not shown) can be used to secure the exterior skin to the handgrip 202.

The top 14 of the right side 20 of the exterior skin 12 exposes a right plate 56 that includes a laser housing 102. The laser housing has a forward facing aperture 104 that exposes the front 108 of a beam projection element in the form of laser diode 106. The laser housing is positioned immediately below the upper edge 220 so the laser housing does not obstruct reciprocation of the slide (not shown) above the upper edge. The laser housing includes a windage screw 112 and an elevation screw 114 that adjust the position of the front of the laser diode to control the point of aim of a laser beam emitted by the laser diode through the forward facing aperture.

Figure 7:
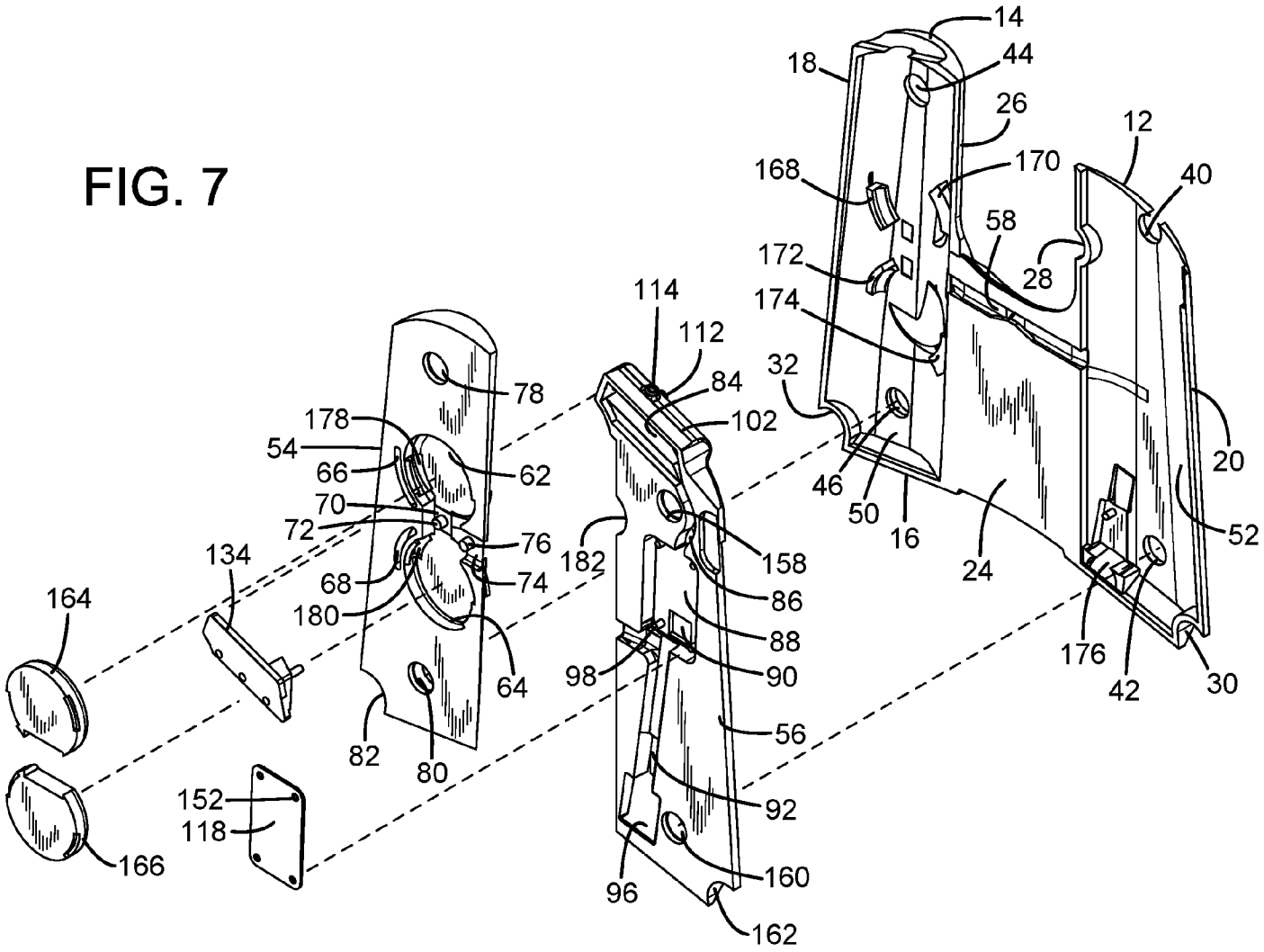
FIG. 7 is an exploded view of the overmold process for the current embodiment of the firearm handgrip assembly with laser gunsight system of FIG. 1.

The interior surface 48 of the exterior skin 12 defines a left plate pocket 50 on the left side 18 and a right plate pocket 52 on the right side 20 (shown in FIG. 7). The plate pockets receive a left plate 54 and the right plate 56, respectively, which are rigid. The front 22 of the interior surface of the exterior skin defines a front flex cable channel 58 that communicates between the left and right plate pockets. The front flex cable channel defines an activation switch pocket 60 at its midpoint. The interior surface of the exterior skin includes additional features that will be described in detail in the discussion of FIG. 5.

The left plate 54 defines an upper battery pocket 62, a lower battery pocket 64, an upper void 66, a lower void 68, a negative contact pocket 70, a negative contact post 72, a positive contact pocket 74, a positive contact post 76, two screw holes 78, 80, and a notch 82. The two screw holes are axially aligned with the screw holes 44, 46 on the left side of the exterior skin 12. The notch is aligned with the notch 32 on the bottom 16 of the exterior skin. The upper and lower battery pockets include additional features that will be described in detail in the discussion of FIGS. 5-7.

The right plate 56 defines a laser diode pocket 84, a wires channel 86, a control circuit receptacle in the form of a PC board pocket 88, a mode selector switch pocket 90, a lower flex cable channel 92, a safety switch pocket 94, a bottom aperture 96, four PC board posts 98, two lower portion posts 100, two screw holes 158, 160, a notch 162, and a notch 182. The two screw holes are axially aligned with the screw holes 40, 42 on the right side of the exterior skin 12. The notch 162 is aligned with the notch 32 on the bottom 16 of the exterior skin. The notch 182 is aligned with the magazine release notch 28 on the exterior skin.

When the firearm handgrip assembly with laser gunsight system 10 is assembled for use, the left and right plates 54, 56 and the interior surface 48 of the exterior skin 12 receive the laser gunsight system components of the present invention. More particularly, the laser gunsight system components include a laser diode 106, a circular coil spring 198, wires 236, a flex cable assembly 116, a PC board 118, a positive contact 120, a negative contact 122, an activation switch 124, a mode selection switch 126, a safety switch 128, upper and lower batteries 130, 132, and a cover plate 134. The laser diode has a front beam emitting end 108 and an opposed rear end 110. The flex cable assembly includes an upper portion 136 that defines four apertures 138, a conductive front flex cable 140 with a left end 142 that defines an aperture 144, a conductive lower flex cable 146, and a lower portion 148 that defines two apertures 150. The PC board defines four apertures 152 that are axially aligned with the four apertures in the upper portion of the flex cable assembly. The positive contact defines an aperture 154. The negative contact defines an aperture 156.

When the firearm handgrip assembly with laser gunsight system 10 is assembled for use, the left and right plates 54, 56 and the interior surface 48 of the exterior skin 12 receive the laser gunsight system components of the present invention. More particularly, the laser diode pocket 84 receives the laser diode 106 and spring 198. The wires 236 electrically connect the laser diode to the upper portion 134 of the flex cable assembly 116 and are received within the wires channel 86. The PC board pocket 88 receives the PC board 118 and the upper portion 136 of the flex cable assembly 116. The apertures 152 in the PC board and the apertures 138 in the upper portion receive the PC board posts 98 to secure and align the PC board and upper portion within the PC board pocket. The lower flex cable 146 electrically connects the upper portion to the front flex cable 140 and the lower portion 148 and is received within the lower flex cable channel 92. The safety switch pocket 94 receives the safety switch 128 and the lower portion. The safety switch is aligned with the aperture 96, and the apertures 150 in the lower portion receive the lower portion posts 100 to secure and align the lower portion and the safety switch within the safety switch pocket.

The activation switch 124 is received within the activation switch pocket 60. The activation switch is electrically connected to the midpoint of the front flex cable 140, which is received within the front flex cable channel 58. The left end 142 of the front flex cable and the positive contact 120 are electrically connected and received within the positive contact pocket 74. The aperture 144 in the left end and the aperture 154 in the positive contact receive the positive contact post 76 to secure and align the left end and positive contact within the positive contact pocket. The negative contact 122 is received within the negative contact pocket 70 and is electrically connected to the left end of the front flex cable. The aperture 156 in the negative contact receives the negative contact post 72 to secure and align the negative contact within the negative contact pocket. The cover plate 134 serves to further secure the left end, positive contact, and negative contact within their respective pockets. The upper battery 130 is received within the upper battery pocket 62, and the lower battery 132 is received within the lower battery pocket 64 to provide a power storage facility.

In the current embodiment, the safety switch 128 enables the laser gunsight system to be operable when in the on position and to be inoperable when in the off position. The activation switch 124 is a momentary switch that enables the upper and lower batteries 130, 132 to power the laser diode 106 when depressed and prevents the laser diode from being powered when released. The mode selection switch 126 determines the characteristics of the laser beam emitted by the laser diode. The available laser beam modes enabled when the activation switch is depressed can include continuously on at full power, dimmed, strobe, and momentary flicker. The mode can be changed by pressing and holding the mode selection switch for five seconds to enter a programming state, whereby the user can change the laser beam mode. To facilitate the user's ability to locate the mode selection switch, the exterior skin 12 may be marked with an indicium 244, such as a logo.

Figure 5:
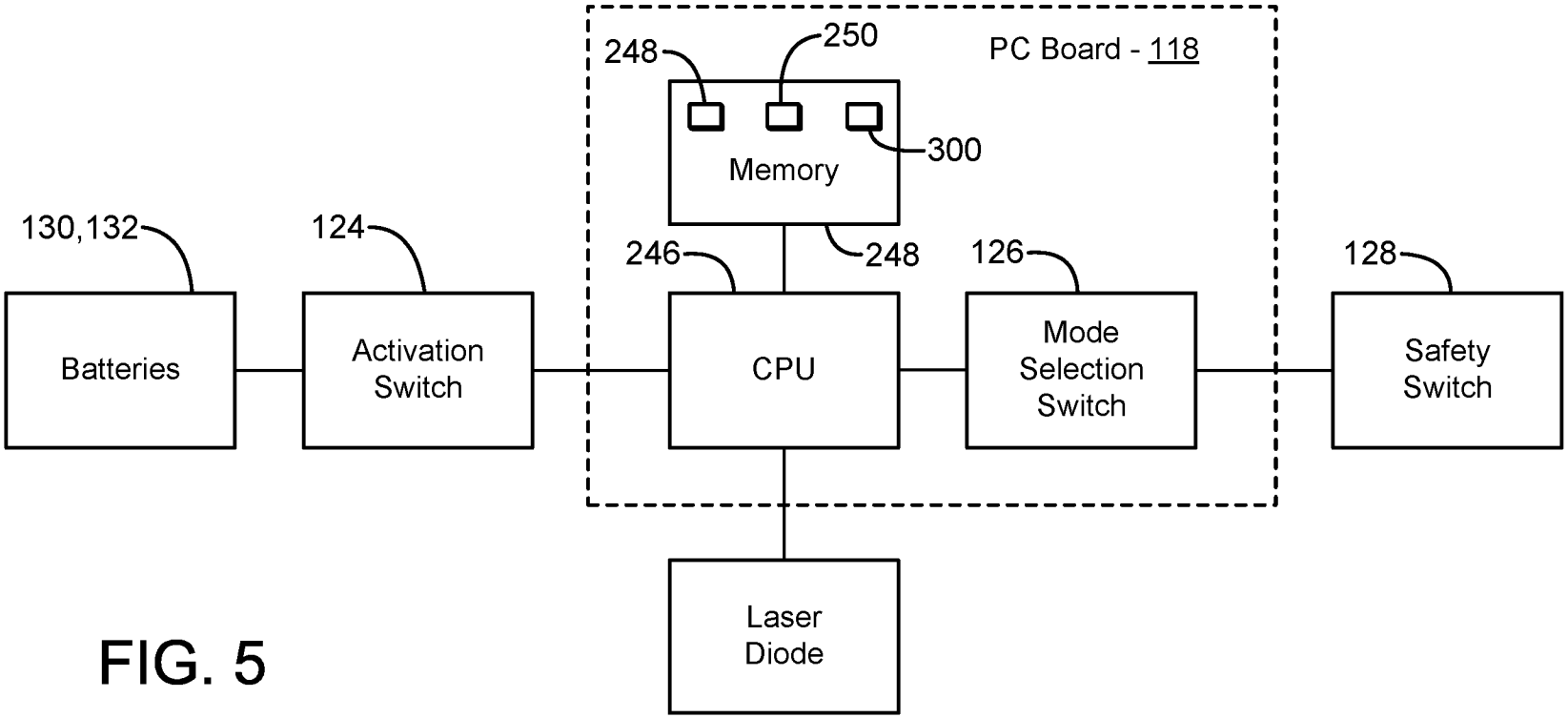
FIG. 5 is a block diagram of the current embodiment of the firearm handgrip assembly with laser gunsight system of FIG. 1.

FIG. 5 is a block diagram illustrating the improved firearm handgrip assembly with laser gunsight system 10 of the present invention. More particularly, the pc board 118 includes memory 248 connected to a Central Processing Unit (CPU) 246 and the mode selection switch 126. The memory stores the current program mode 250 and brightness setting 252, as well as programming state program 300. The CPU uses the current program mode and brightness setting to control the laser beam emitted by the laser diode 106 when the safety switch 128 is in the on position and the activation switch 124 is actuated. When the activation switch is actuated, the CPU controls the flow of electricity from batteries 130,132 to laser diode 106 to produce a laser beam having the characteristics prescribed by the current program mode and brightness setting.

The firearm handgrip assembly with laser gunsight system 10 (including the laser beam emitting laser diode 106 and controller CPU 246 with connected memory 248) has three switches connected to the controller. The first switch (safety switch 128) is an on-off switch that prevents any operation when in a first position, and enables operation when in a second position. The safety switch is stable in each position so that it remains in the selected position when set and released. A second switch (activation switch 124) is a momentary switch that is accessible for operation in a location while the user is gripping the gun for firing. The activation switch has an on and an off position, and is biased to the off position so that it is in the on position only when pressure is applied by the user. A third switch (mode selection switch 126) establishes the operating mode when the safety switch and activation switch are both on. The mode selection switch is also a momentary switch that is biased to an open position, and which sends a signal to the controller circuitry in response to momentary pressure (a tap or push). The controller has several operating modes, and sequential pushes on the mode selection switch cycle the controller through the different operating modes. The available operating modes will be discussed subsequently in the description of FIG. 6.

The first switch (safety switch 128) is preferably a toggle switch located in a recess at the base of one of the grip panels (left and right plates 54, 56), so that it is not accidentally switched, but may be switched only by deliberate action with a fingernail or small tool. The second switch (activation switch 124) is preferably located on the front strap 212 of a pistol handgrip 202 below the trigger guard 216, where the activation switch rests under the user's middle finger as it naturally grips the gun. The third switch (mode selection switch 126) is preferably located in the middle of a grip panel, under a distinctive feature such as a logo medallion (indicium 244) to enable a user to locate it. Operation of the mode selection switch requires a deliberate pressure with a fingertip.

The activation and mode selection switches 124, 126 include a flexible exterior skin membrane 12 covering them (activation switch cover 36 and indicium 244). The membrane is coextensive to cover the grip panels (left and right plates 54, 56) to provide a resilient gripping surface.

When the firearm handgrip is gripped by a user's hand for firing, the activation switch 124 will be covered by the user's finger for selectable actuation, mode selection switch 126 will be covered by the palm of the user's hand to prevent actuation, and the safety switch 128 will be away from the user's hand to avoid actuation. The controller has electrical connections to each of the three switches.

FIG. 6 is a flowchart of the programming state program 300 for use with the improved firearm handgrip assembly with laser gunsight system 10 of the present invention. More particularly, the program starts (310) by checking if the mode selection switch 126 has been depressed for 5 seconds (312). If the mode selection switch has been depressed for five seconds, the CPU 246 retrieves the current program mode 250 and brightness setting 252 from memory 248. Subsequently, the CPU causes the laser diode 106 to illuminate in the manner prescribed by the current program mode and brightness setting (316). If the mode selection switch has been depressed within the last five seconds (318), the CPU changes the current program mode to the next program mode and stores the change as the current program mode in memory 248. The program then returns to step 316, which gives the user an opportunity to view the result and make additional changes to the characteristics of the laser beam if desired.

If the mode selection switch 126 has not been depressed within the last five seconds at step 318, the program checks if the activation switch 124 has been depressed within the last five seconds (322). If the activation switch has been depressed within the last five seconds, the CPU 246 changes the current brightness setting to the next brightness setting and stores the change as the current brightness setting in memory 248. The program then returns to step 316, which gives the user an opportunity to view the result and make additional changes to the characteristics of the laser beam if desired. Once five seconds have passed without the user pressing either the mode selection switch or the activation switch, the program ends (326).

In the current embodiment, the mode selection switch 126 is used to cycle between flashing, stealth target, or steady modes. In flashing mode, the laser will blink twice per second while the activation switch 124 is depressed. In stealth target mode, a press of the activation switch activates a burst of three quick flashes of the laser beam, then the laser diode turns off for stealth targeting. This mode will repeat with each press of the activation button. The user can hold the activation button down to override the stealth target mode and enter steady mode. In steady mode, pressing and holding the activation button results in a continuous laser beam.

In the current embodiment, the activation switch 124 is used in the programming state to set one of three levels of laser beam brightness. Each time the activation switch is pressed and released in the programming state, the laser beam's brightness will be reduced by one level. After the minimum brightness level setting is reached, the next press of the activation switch will return the laser beam's brightness to the maximum brightness setting.

FIG. 7 illustrates the overmold process used to manufacture the improved firearm handgrip assembly with laser gunsight system 10 of the present invention. More particularly, in the current embodiment the firearm handgrip assembly with laser gunsight system 10 is a unitary molded piece comprising two materials. The exterior skin 12 is made of thermoplastic elastomer in the current embodiment. However, the exterior skin may be any elastomeric material preferably having a minimum durometer hardness of 30 A in order to provide adequate firmness to retain shape and resist dislocation, and preferably having a hardness of no more than 80 A so the material maintains sufficient elasticity to be comfortable to grip. The left and right plates 54, 56 are a rigid material, which is a hard plastic element molded into the rubber exterior skin in the current embodiment. It is desirable for the two materials to form a chemical bond between them. Such a molding process is described in U.S. Pat. No. 6,301,817 (Hogue et al.).

Prior to the overmolding process, the exterior skin 12, left plate 54, right plate 56, cover plate 134, and PC board 118 are fabricated as discrete components. The interior surface 24 of the exterior skin includes upper protrusions 168, 170 and lower protrusions 172, 174 on the left side 18. The upper protrusions are aligned with apertures 178, 190 formed in the upper battery pocket 62 of the left plate when the left plate is molded into the left plate pocket 50 in the exterior skin. The lower protrusions are aligned with apertures 180, 196 formed in the lower battery pocket 64 of the left plate when the left plate is molded into the left plate pocket in the exterior skin.

An aperture 176 is present at the bottom 16 of the right side 20 of the exterior skin 12. The aperture is aligned with the aperture 96 in the bottom of the right plate 56 when the right plate is molded into the right plate pocket 52 in the exterior skin. The apertures enable the user to access the safety switch 128 while the firearm handgrip assembly with laser gunsight system 10 is installed on a pistol frame 200.

Figure 8:
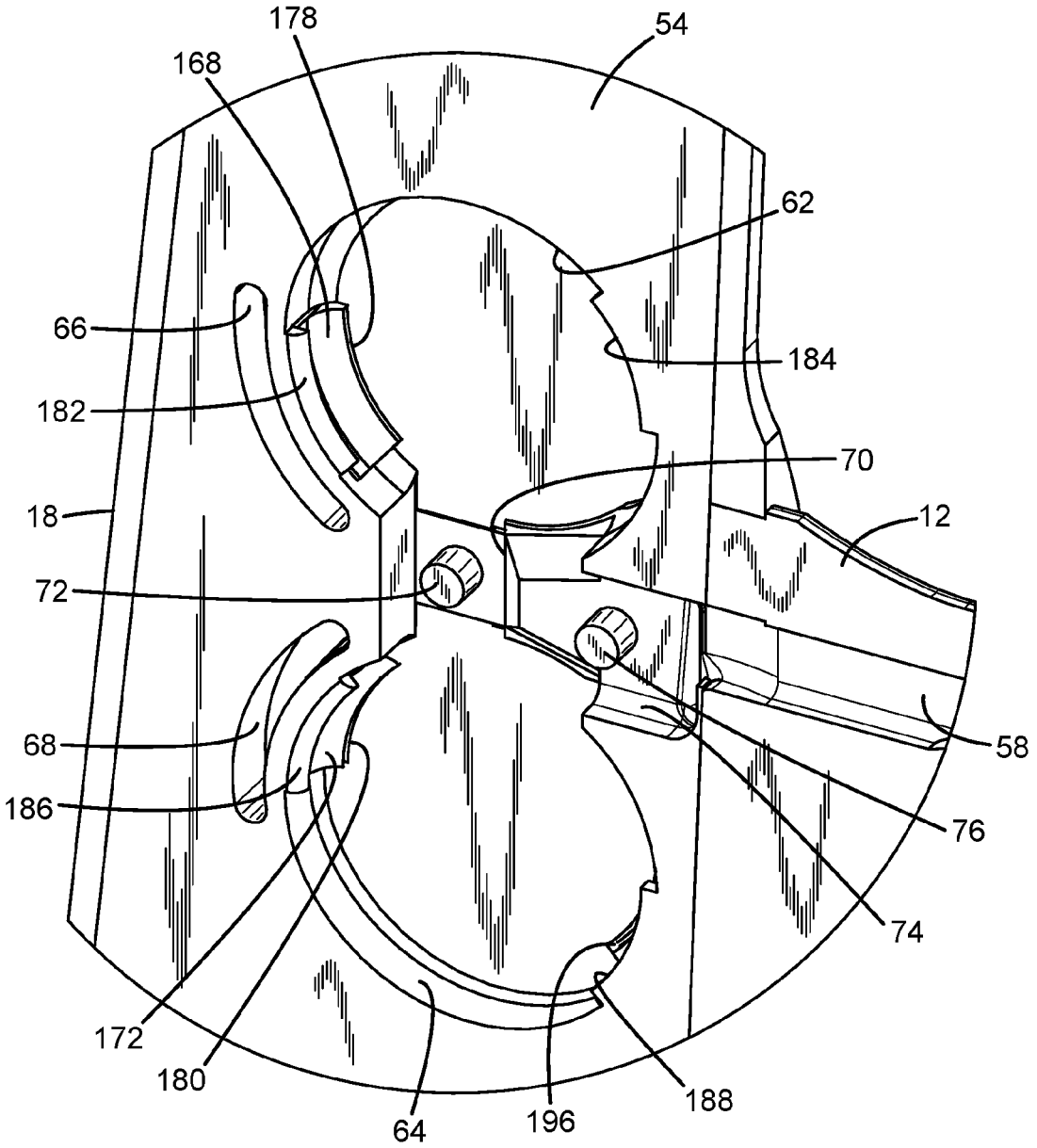
FIG. 8 is an enlarged view of the upper and lower battery pockets of the current embodiment of the firearm handgrip assembly with laser gunsight system of FIG. 1.
Figure 9:
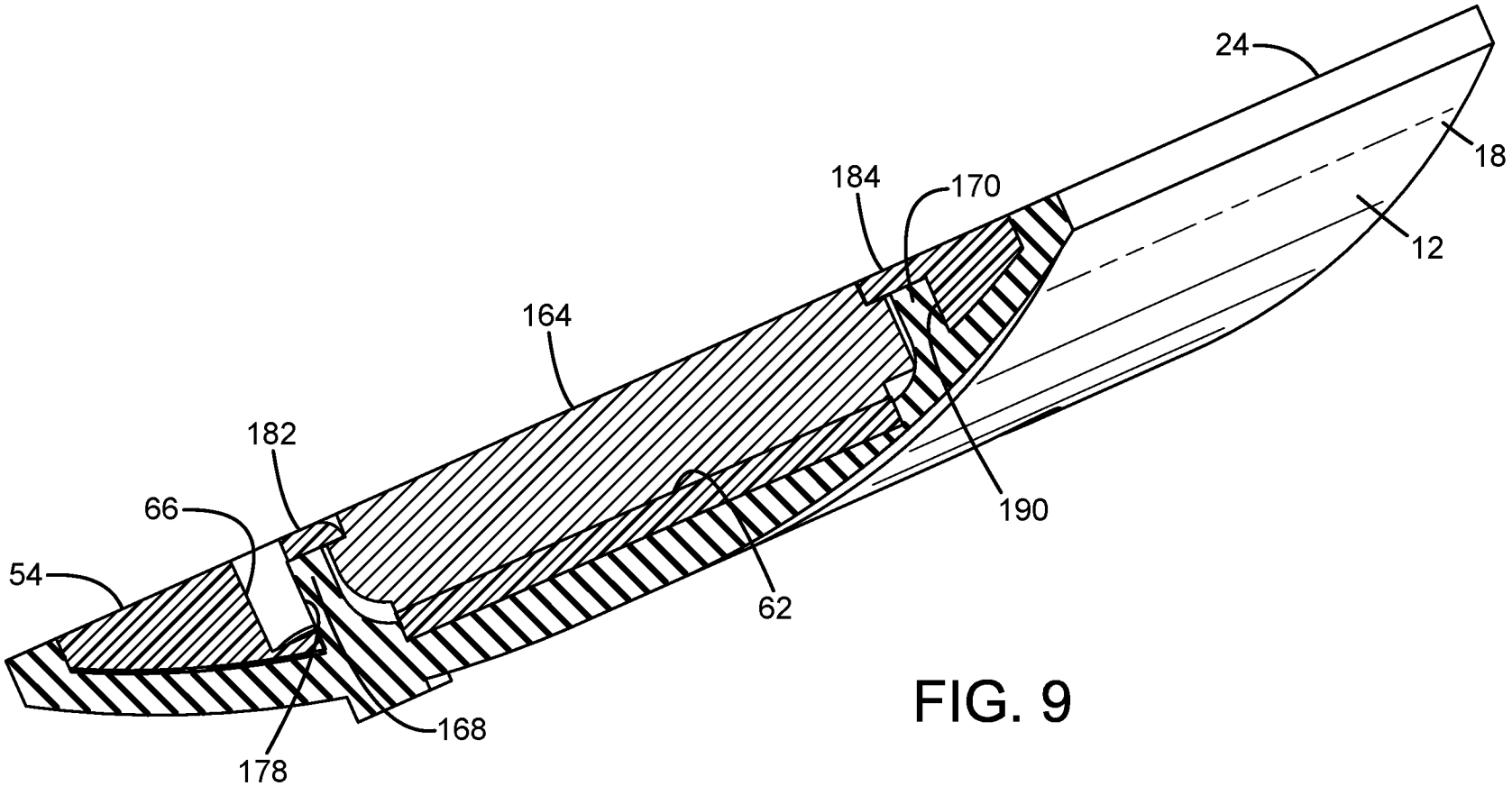
FIG. 9 is a top angled sectional view of the upper battery pocket of the current embodiment of the firearm handgrip assembly with laser gunsight system of FIG. 1.

FIGS. 8 and 9 illustrate the improved upper and lower battery pockets 62, 64 of the present invention. More particularly, the apertures 178, 190 in the upper battery pocket and the apertures 180, 196 in the lower battery pocket enable the upper protrusions 168, 170 and lower protrusions 172, 174 to enter into the upper and lower battery compartments during the overmolding process and fit into undercuts beneath the upper battery retention surfaces 182, 184 and lower battery retention surfaces 186, 188. To prevent the upper and lower protrusions from distorting during the overmolding process, dummy upper battery 164 and dummy lower battery 166 are inserted into the upper and lower battery pockets prior to molding. The dummy upper and lower batteries serve as supports for the thin upper and lower protrusion membranes during the overmolding process. The dummy upper and lower batteries are then removed from the upper and lower battery compartments.

The upper and lower protrusions serve to hold the upper and lower batteries 130, 132 in place despite any shock or vibration that the firearm handgrip assembly with laser gunsight system 10 may experience. The upper and lower batteries are firmly held in place yet easily removable because of the presence of upper void 66 and lower void 68. The upper and lower voids make the upper battery retention surface 182 and lower battery retention surface 186 thin and flexible. As a result, the user can flex the upper and lower battery retention surfaces into the upper and lower voids in order to remove the upper and lower batteries. The replacement upper and lower batteries will then flex the upper and lower battery retention surfaces into the upper and lower voids when the batteries are inserted, and the upper and lower battery retention surfaces will then snap back into place to firmly hold the batteries.

Figure 10:
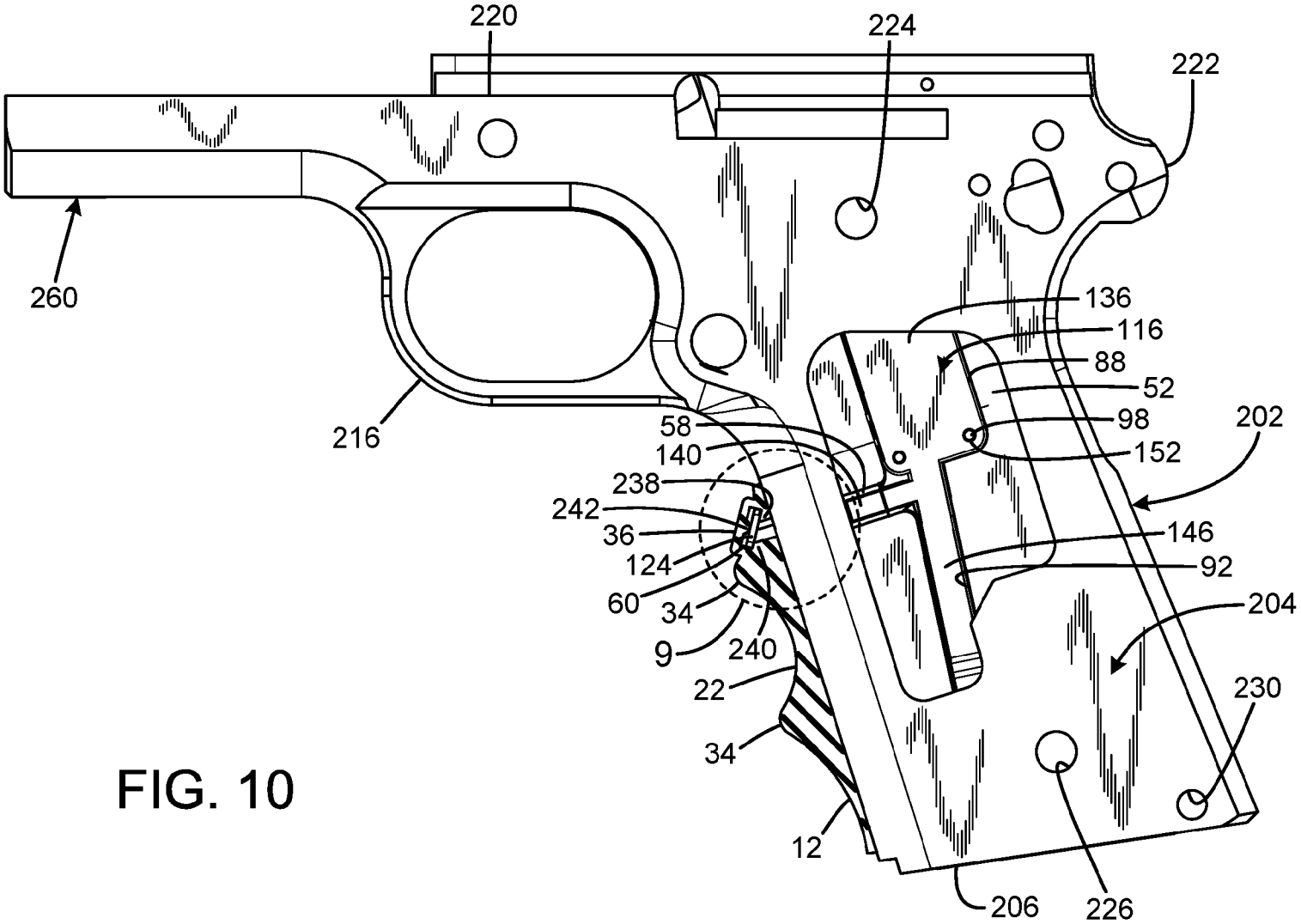
FIG. 10 is a sectional view of the right side of the current embodiment of the firearm handgrip assembly with laser gunsight system installed on the pistol frame of a M1911-type pistol.
Figure 11:
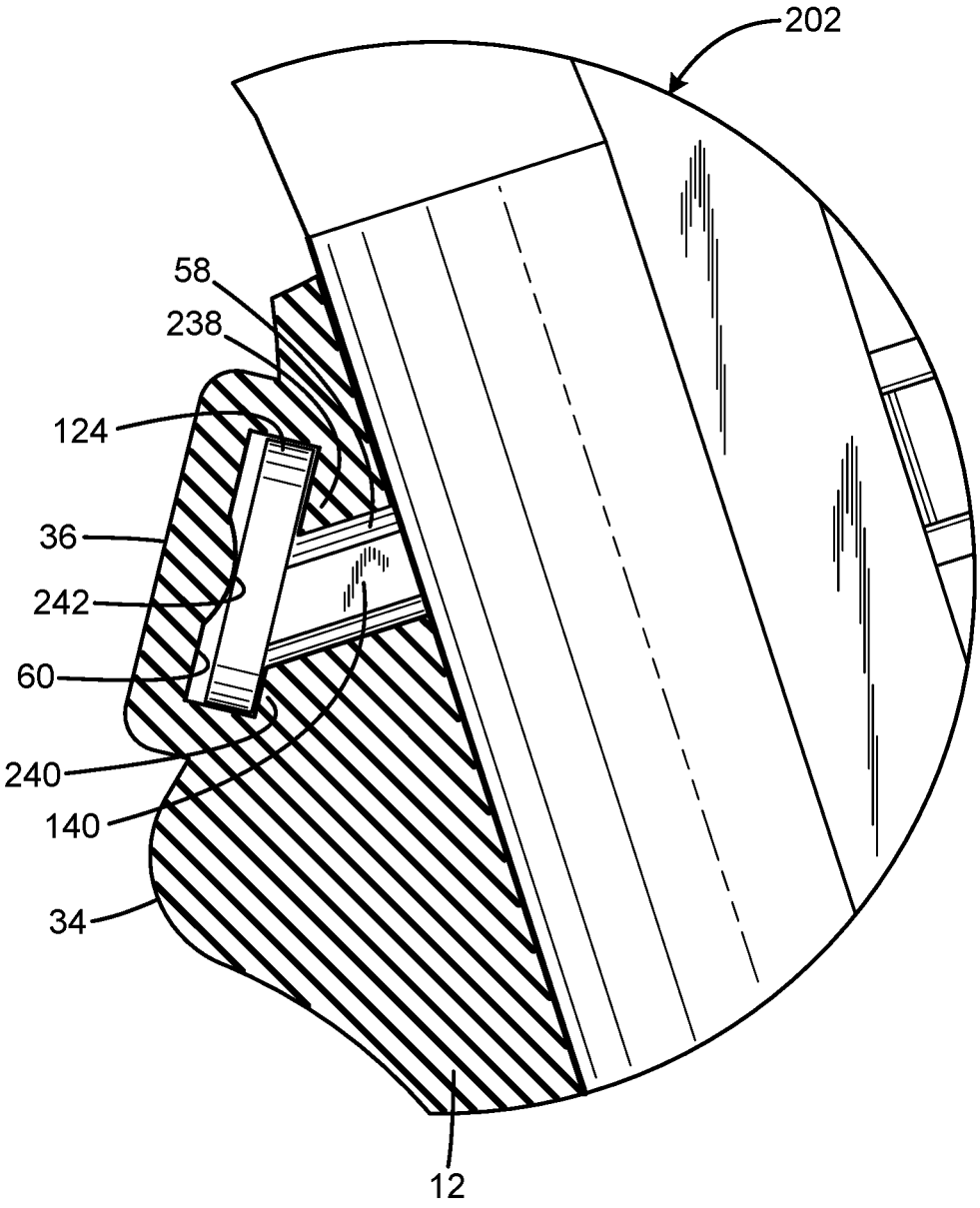
FIG. 11 is an enlarged view of the activation switch pocket of FIG. 10 denoted by the circled portion 11.
Figure 12:
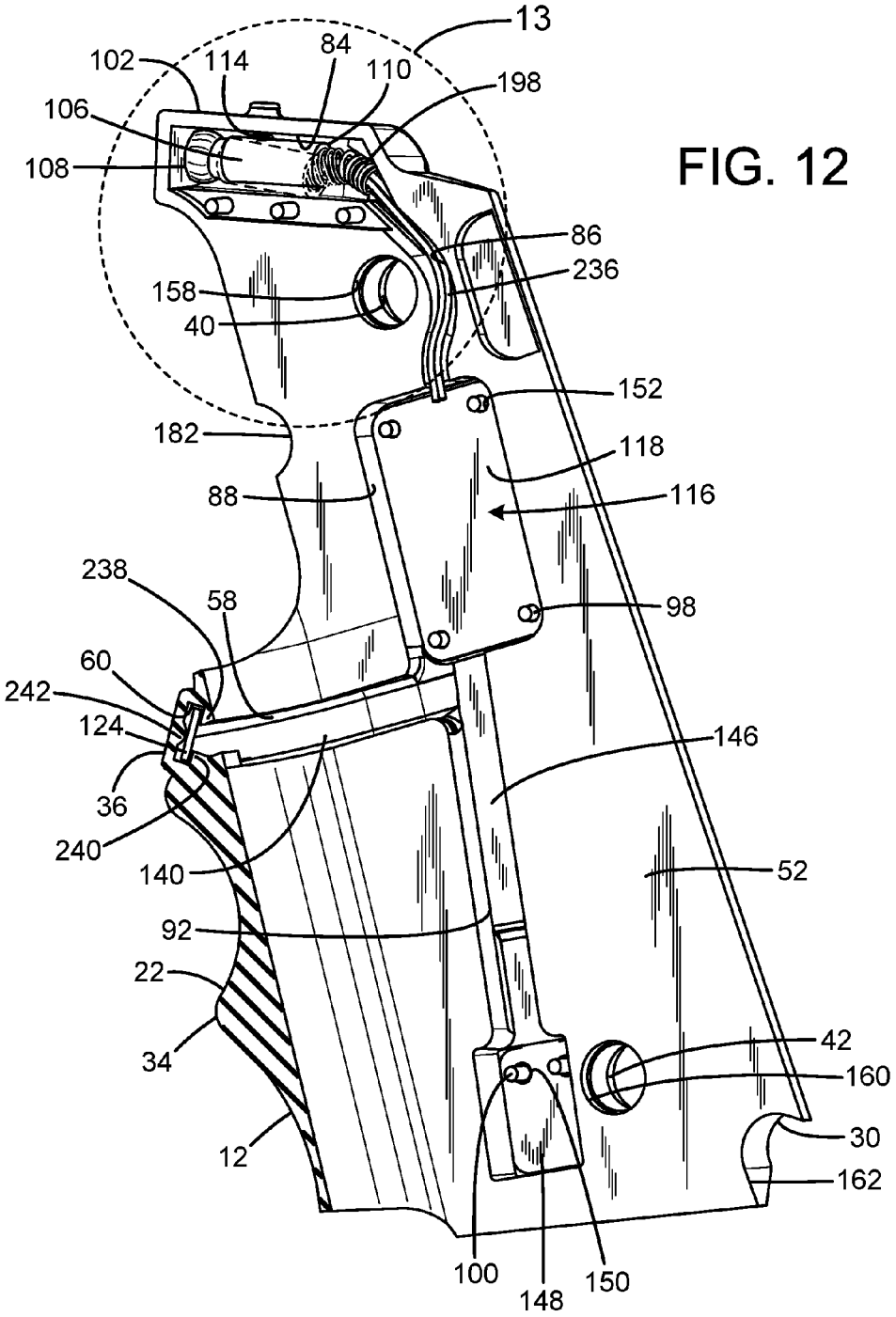
FIG. 12 is a sectional view of the right side of the current embodiment of the firearm handgrip assembly with laser gunsight system of FIG. 1.
Figure 13:
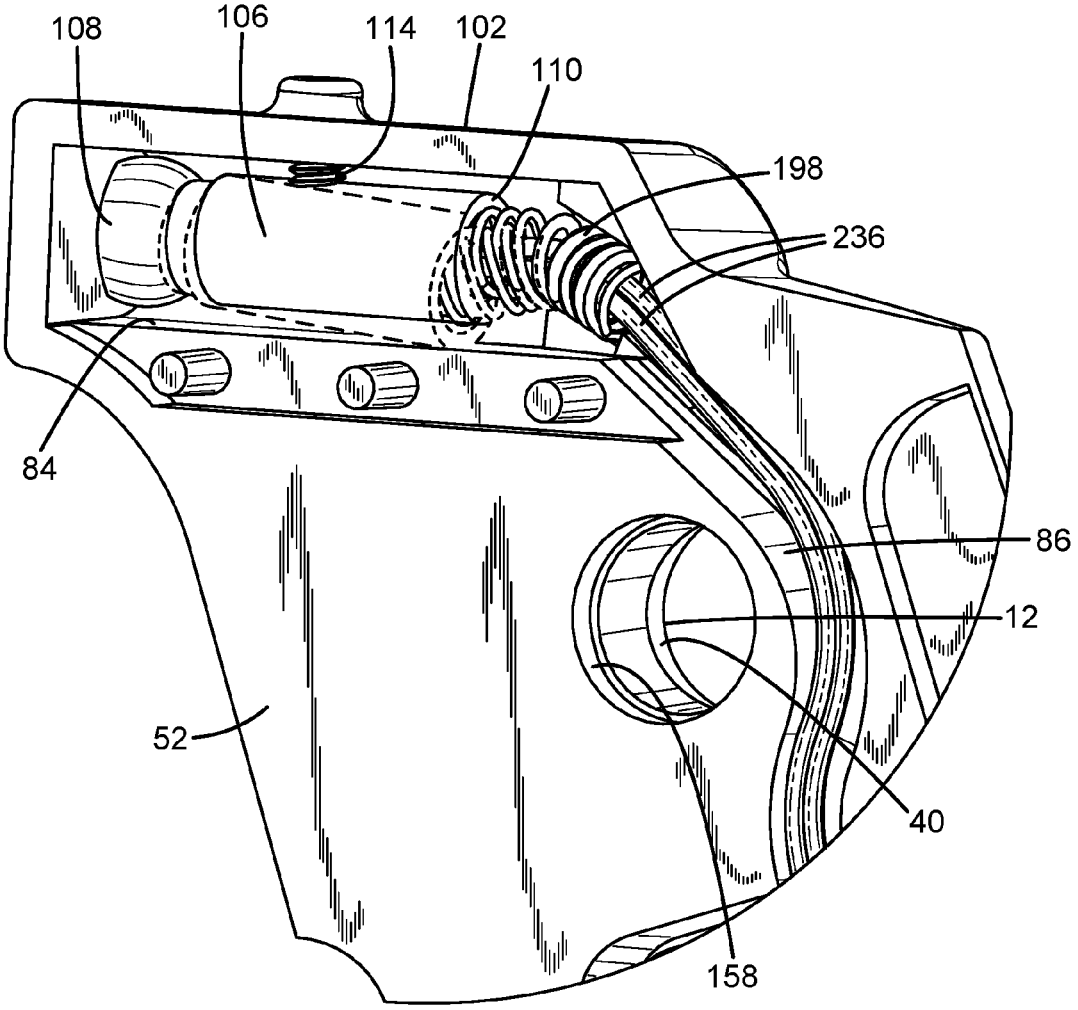
FIG. 13 is an enlarged view of the laser pocket of FIG. 12 denoted by the circled portion 13.
Figure 14:
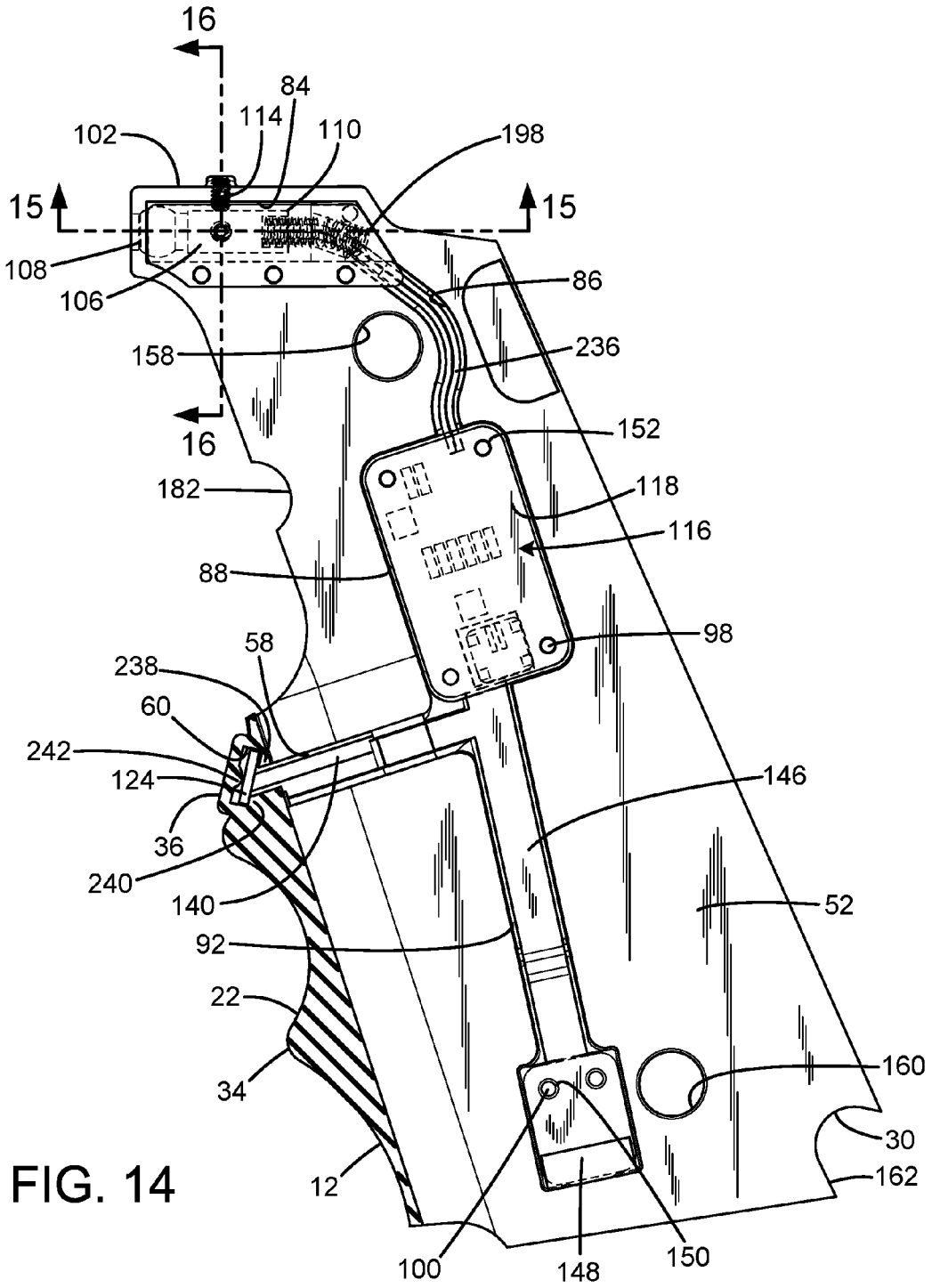
FIG. 14 is a sectional view of the right side of the current embodiment of the firearm handgrip assembly with laser gunsight system of FIG. 1.
Figure 15:
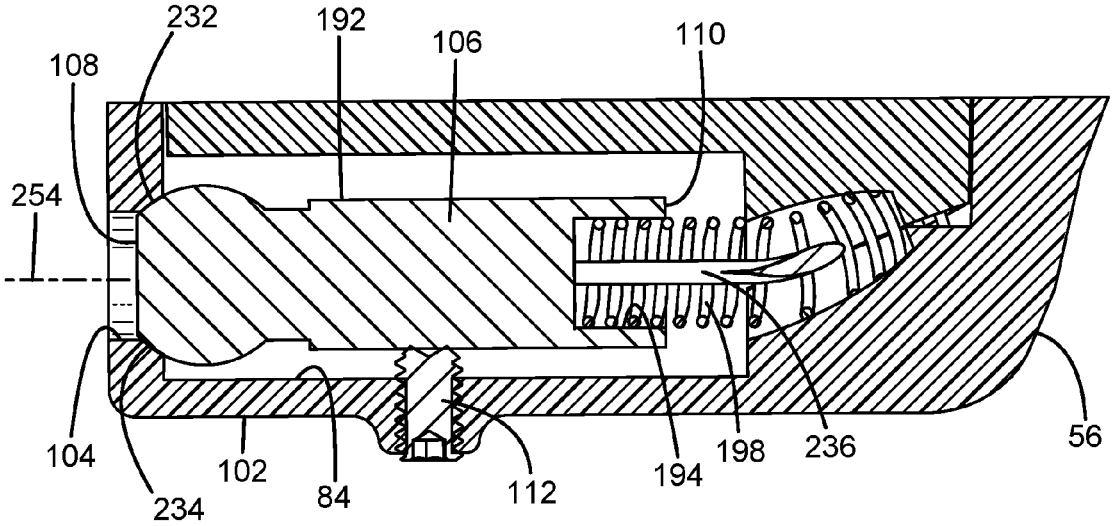
FIG. 15 is a sectional view taken along line 15-15 of FIG. 14.
Figure 16:
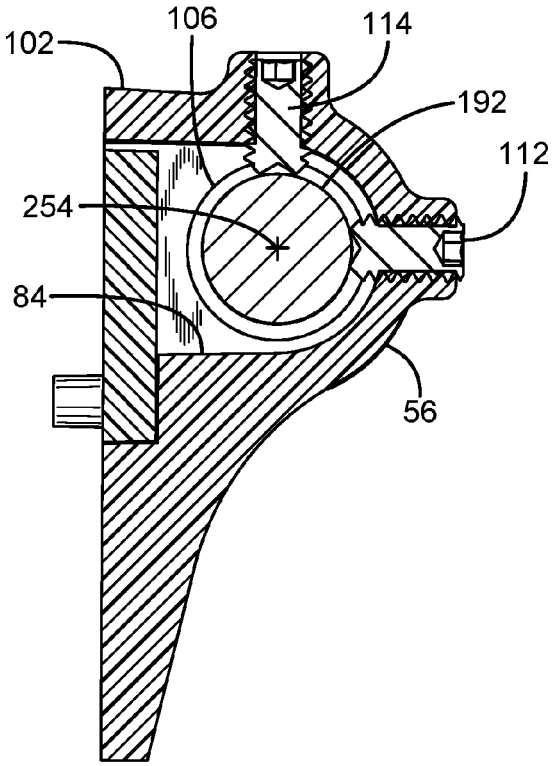
FIG. 16 is a sectional view taken along line 16-16 of FIG. 14.

FIGS. 10 and 11 illustrate the improved activation switch cover 36 and activation switch pocket 60 of the present invention. More particularly, the activation switch pocket is located in the middle of the front 22 of the interior surface 24 of the exterior skin 12 and is in communication with the front flex cable channel 58. The activation switch pocket receives the activation switch 124. The activation switch is held in an angled forward position parallel to the activation switch cover 36 by two elastomeric/compressible flaps 238, 240. The flaps are shaped to support the activation switch in that position. The activation switch cover 36 is a membrane that both protects the activation switch from the external environment and flexes to allow the activation switch to be actuated when the user squeezes the activation switch cover. The underside of the activation switch cover defines an elastomeric bump 242 that contacts the activation switch.

The elastomeric/compressible flaps 238, 240 further provide a compressible backing support for the activation switch 124. The compressible backing support and the elastomeric bump 242 enable the firearm handgrip assembly with laser gunsight system 10 to accommodate variations in frame tolerances between M1911 pistols produced by different manufacturers. If the activation switch pocket did not include a compressible backing support and elastomeric bump, the amount of pressure required to actuate the activation switch would vary considerably depending on the specific M1911 pistol frame the firearm handgrip assembly with laser gunsight system 10 was attached to. Substantial variability in actuation pressure could be problematic for both manufacturing quality control and for the user. By using both the elastomeric bump and the two elastomeric/compressible flaps, minimally variable actuation pressure is achieved regardless of which M1911 pistol frame the firearm handgrip assembly with laser gunsight system 10 is attached to.

FIGS. 12-16 illustrate the improved laser housing 102 and laser diode 106 of the present invention. More particularly, the rear 110 of the laser diode has a central bore 194 that receives one end of the circular coil spring 198. The circular coil spring not only provides stress relief for the wires 236 as the wires enter the wires channel 86, but the spring also urges the exterior surface 192 of the laser diode against the windage screw 112 and elevation screw 114, thereby fixing the laser diode in place within the laser diode pocket 84 of the laser housing. As a result, the point of aim of a laser beam emitted by the front 108 of the laser diode through the front facing aperture 104 of the laser housing along optical axis 254 is determined and can be adjusted by the extent to which the windage screw and elevation screw penetrate into the laser diode pocket. Curved surfaces 232, 234 adjacent to the front facing aperture form a socket that engages with the spherical surface portion of the front of laser diode to form a ball and socket joint, which enables the front of the laser diode to pivot within the socket. The spring also serves to bias the spherical surface portion of the front of the laser diode towards the socket.

In use, the firearm handgrip assembly with laser gunsight system 10 is installed on the standard factory-supplied handgrip 202 of a pistol with removable grips. To attach the firearm handgrip assembly with laser gunsight system 10, the grips are removed from the handgrip by unscrewing the factory-supplied screws from the handgrip. Subsequently, the right plate 56 is attached to the right side 208 of the handgrip using the factory supplied screws, the front 22 of the exterior skin 12 is wrapped around the front strap 212 below the trigger guard 216, and the left plate 54 is attached to the left side 210 of the handgrip using the factory supplied screws.

The firearm handgrip assembly with laser gunsight system 10 is then ready to undergo the sighting-in procedure. While squeezing the activation switch cover 36 to activate the laser diode 106, the user fires a few rounds at a target. After noting where the bullets are striking relative to the laser beam reflection on the target is located, the user adjusts the windage screw 112 and/or the elevation screw 114 until subsequent fired rounds impact where the laser beam reflection on the target is located. The laser diode will remain sighted-in until the right plate 56 is loosened or detached from the handgrip 202.

Although the upper and lower batteries 130, 132 will provide sufficient power for the laser diode 106 to illuminate for several hours, the batteries eventually require replacement. Fortunately, both batteries can be replaced without loosening or detaching the right plate 56 from the handgrip 202. Instead, the user merely detaches the left plate 54 from the left side 210 of the handgrip by unscrewing the factory-supplied screws on the outside while the right plate remains firmly secured to the handgrip. The spent batteries are removed, new batteries are inserted, and the left plate is reattached to the left side of the handgrip without any disturbance to the position of the right plate or the laser diode. As a result, both batteries can be replaced without requiring the user to repeat the sighting-in process since no point of aim error can be introduced by the battery change process. Optionally, different screw types or screw caps could be used for the left plate and right plate to convey which plate is intended to be removed for routine access and which is not intended to be removed.

In the context of the specification, the terms "rear" and "rearward," and "front" and "forward," have the following definitions: "rear" or "rearward" means in the direction away from the muzzle of the firearm while "front" or "forward" means it is in the direction towards the muzzle of the firearm.

While a current embodiment of a firearm handgrip assembly with laser gunsight system has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, while M1911 pistols as described are the most likely contemplated application for the concepts of the present invention, it should be appreciated that the current invention could be used with any firearm grip, including revolvers and rifles such as AR-15s, as well as hand and power tools and other implements with a handgrip.

Therefore, the foregoing is considered as illustrative only of the principles of the invention.

Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An aiming device for a firearm comprising:

a frame adapted for connection to the firearm;

a beam projection element and a power source operably connected to each other, and at least one of the beam projection element and the power source connected to the frame;

an elastomeric element connected to the frame;

the elastomeric element defining a pocket adapted to removably receive a switch operably connected to the beam projection element via an electrical conductor;

the pocket having an internal periphery having a first size selected to closely receive the switch;

the pocket defining an access aperture having a second size smaller than the first size, such that a switch within the pocket will not readily exit the pocket except upon deformation of the access aperture; and the electrical conductor passing through the access aperture.

2. The aiming device of claim 1 wherein the access aperture includes an elastic flap partially obstructing the pocket.

3. The aiming device of claim 2 including opposed flaps defining the access aperture.

4. The aiming device of claim 1 wherein the frame is an inelastic material.

5. The aiming device of claim 1 including a second frame connected to the frame by way of the elastomeric element.

6. The aiming device of claim 5 wherein the second frame includes at least one of a beam projection element, a power source, and a control circuit.

7. The aiming device of claim 5 wherein the elastomeric element defines a channel extending from the first frame to the pocket and a second channel extending from the pocket to the second frame.

8. The aiming device of claim 1 including the elastomeric element defining a channel communicating with the pocket.

9. The aiming device of claim 1 wherein the elastomeric element overlays an external surface of the frame away from the firearm.

10. The aiming device of claim 1 wherein the frame is operable to connect to a grip of a firearm.

11. A firearm grip assembly for attachment to a firearm having a grip with opposed sides comprising:

a first frame element adapted for connection to a first side of the firearm grip;

a second frame element adapted for connection to an opposed second side of the firearm grip;

an elastomeric web extending from the first frame element to the second frame element;

the web having a rear surface facing a rear direction between the first and second frame elements when the first and second frame elements are connected to a firearm;

the web defining a pocket in the rear surface;

the pocket being configured to closely receive a switch element in operable communication via a first electrical conductor with a first electronic element on the first frame, via a second electrical conductor with a second electronic element on the second frame;

the pocket having a reduced aperture at the rear surface to resist removal of the switch from the pocket except upon deformation of the aperture; and the first and second electrical conductors passing through the aperture.

12. The aiming device of claim 11 including the rear aperture including a flap partially overlaying the pocket.

13. The aiming device of claim 12 including opposed flaps defining the access aperture.

14. The aiming device of claim 11 including first and second electronic elements selected from a group including power supply, illuminator, aiming element, and control circuitry.

15. The aiming device of claim 11 including the elastomeric element defining a first channel extending from the first frame to the pocket, and a second channel extending from the pocket to the second frame, such that conductors connected to the switch may occupy the channels.

16. The aiming device of claim 11 wherein the first and second frame elements are an inelastic material.

17. The aiming device of claim 11 wherein the elastomeric web overlays an external surface of the first and second frame elements away from the firearm.

* * * * *